United States Patent [19]

Frühwirth

[11] 4,120,423

[45] Oct. 17, 1978

[54] CIGARETTE DISPENSER

[76] Inventor: Rudolf Frühwirth, Klusemannstrasse 4, 8053 Graz, Austria

[21] Appl. No.: 804,873

[22] Filed: Jun. 9, 1977

[30] Foreign Application Priority Data

Jun. 10, 1976 [AT] Austria ..... 4245/76

[51] Int. Cl.[2] ..... B65G 59/00

[52] U.S. Cl. ..... 221/115; 221/116; 221/143; 221/225; 221/228; 221/232

[58] Field of Search ..... 221/136, 143, 225, 224, 221/226, 227, 228, 229, 230, 232, 236, 110, 116

[56] References Cited

U.S. PATENT DOCUMENTS

| | | | |
|---|---|---|---|
| 1,616,864 | 2/1927 | Martin | 221/116 X |
| 2,475,999 | 7/1949 | Sparagano | 221/232 X |
| 2,655,258 | 10/1953 | Weigler | 221/232 X |
| 3,164,295 | 1/1965 | Shwarz | 221/232 X |

FOREIGN PATENT DOCUMENTS

| | | | |
|---|---|---|---|
| 184,064 | 5/1936 | Switzerland | 221/116 |
| 249,300 | 3/1926 | United Kingdom | 221/116 |

*Primary Examiner*—Allen N. Knowles
*Attorney, Agent, or Firm*—Salter & Michaelson

[57] ABSTRACT

A cigarette dispenser comprising a casing having a plurality of dispensing means each movable to dispense a cigarette through a dispensing opening, slide means operable to actuate said dispensing means, and cam means associated with said slide means whereby successive movements of the latter actuates said dispensing means one at a time and in sequence.

12 Claims, 10 Drawing Figures

CIGARETTE DISPENSER

This invention relates to a cigarette dispenser having a casing for the cigarettes and preferably also for a lighter, in which casing there are arranged at least two dispensing means slidably guided in direction towards an opening of the casing, which dispensing means are urged towards their starting positions by resilient means, for example a spring or the like. Each dispensing means is adapted to underlie a cigarette by means of a protrusion and is adapted to carry the cigarette towards the opening of the casing, when the dispensing means is slidably moved. Further, an actuating mechanism is arranged in the casing which actuating mechanism is adapted to urge the cigarettes towards the dispensing means.

There have already become known some dispensing apparatus for cigarettes arranged in a casing. These known apparatus however are of complicated construction and are very often subject to defects. Further, the known apparatus are space consuming. Last not least they have the disadvantage that the cigarettes are very often jammed in the dispenser so that the cigarettes are damaged and/or the dispenser is not reliable in operation.

It is an object of the present invention to avoid these disadvantages of the known apparatus.

It is another object of the present invention to provide for a cigarette dispenser which allows arranging more than one row of cigarettes in the casing.

It is another object of the invention to make the cigarette dispenser free of defects and reliable in operation.

It is also an object of the present invention to provide for a cigarette dispenser of small dimensions so that it can easily be put into a pocket.

The invention essentially consists in that a slider means is disposed in or on the casing which slider means is adapted to be slidably moved by a handle means towards or away from the opening of the casing and is loaded by resilient means so that it is retracted into its starting position, and that a cam means is rotatably arranged on the slider means which cam means has cam surfaces the number of which corresponds to the number of dispensing means and which are staggered on the cam means seen in peripheral direction thereof, said cam means being adapted to cooperate with protrusions on said dispensing means, and wherein the slider means is adapted to be moved towards the opening of the casing beyond a dispensing position in which one of the dispensing means dispenses a cigarette, said cam means being tilted or turned by the cam surface cooperating with said dispensing means when said slider means is moved beyond said dispensing position.

By this arrangement of the cigarette dispenser it is secured that only one single dispensing means of the plurality of dispensing means is always slidably moved towards the opening of the casing because always only one single cam surface arranged on the cam means operatively cooperates with one of the dispensing means whereas the other cam surfaces of the cam means are so situated that no movement of the other dispensing means takes place when said slider means is slidably moved towards the opening of the casing. This facilitates it considerably to highly reduce the dimensions of the dispenser because the cam means consumes a very small space only. Thus it is possible to arrange more than one rows of cigarettes one next to the other but moving always one single cigarette only (on each actuating of the slider means) towards the dispensing opening of the casing. When the respective dispensing means has reached its position in which the cigarette is dispensed and in which the dispensing means cannot be moved any further, the cam means is rotated on further moving the slider means, which may be a slider or the like. This rotation of the cam means, which may be in the form of a cam shaft, has as a consequence that during the next motion of the slider means another cam surface cooperates with another dispensing means so that this further dispensing means moves a cigarette towards the opening of the casing when the next operation of the slider means takes place.

In order to better secure that the cam surfaces initiate the desired rotating motion of the cam shaft in the dispensing end position of a dispensing means, in which position a cigarette is dispensed from the casing, according to a further important feature of the present invention the cam surfaces are pointed on their free ends.

According to a further feature of the invention, the spring which retracts the slider means into its starting position is anchored on the bottom of the casing and is fixed to the slider means by the means of a line, which is preferably fixed to a bifurcated member embracing the slider means. Within such an embodiment the spring which retracts the slider means can be arranged in a position in which there is sufficient space for fitting it.

The invention is shown by way of example in the accompanying drawing.

Figure 4:
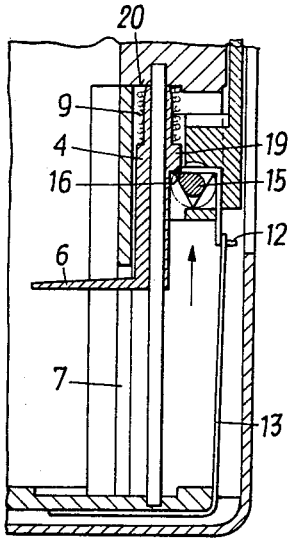
Figure 5:
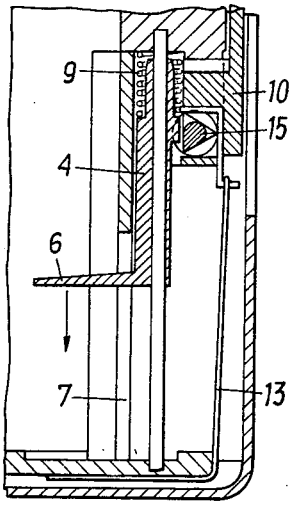
Figure 6:
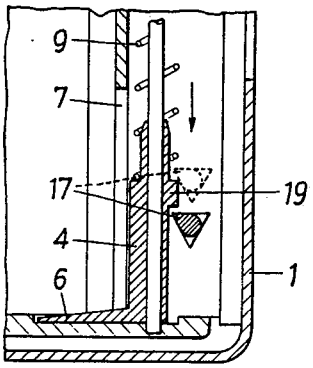

The FIGS. 4, 5 and 6 respectively show the cam shaft in its various positions.

Figure 7:
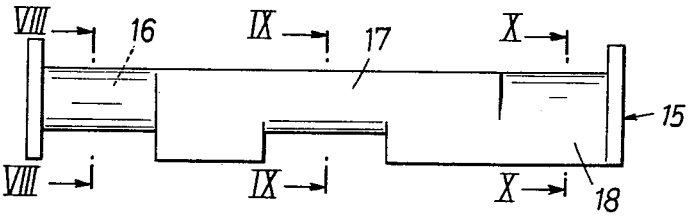

FIG. 7 shows a side elevation of the cam shaft at an enlarged scale.

Figure 8:
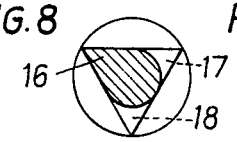
Figure 9:
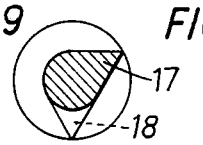
Figure 10:
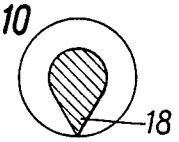

The FIGS. 8, 9 and 10 are sections along the lines VIII—VIII, IX—IX and X—X respectively of FIG. 7.

The dispensing apparatus according to the present invention has a casing 1 which can be closed by a cover member 2. In the casing 1 three dispensing means 4 are slidably guided, each of which has a protrusion 6 which underlies a cigarette 5 which is shown by dashed and dotted lines. The dispensing means 4 are so guided in guide means 7 of the casing 1 that they can be slidably moved towards an opening 8 of the casing 1, which opening 8 may be freed by sliding the cover member on the upper margin of the casing 1. Each dispensing means 4 is spring-loaded by a spring 9 which urges the dispensing means 4 towards its lower end position shown in FIGS. 1, 2 and 3.

A slider 10 is arranged in the casing 1 and is adapted to be slidably moved towards the dispensing opening 8 of the casing 1. The slider 10 is slidably guided along the side walls of the casing 1 and is fixed to an actuating handle 11. The slider 10 has a bifurcated member 12 which is connected to a string or line 13 which in turn is connected to a spring 14 arranged in the hollow bottom of the casing 1. This spring 14 retracts the slider 10 via the line 13 into its lower end position as soon as the handle 11 is left free.

A cam shaft 15 is rotatably arranged in the slider 10 and has on its surface three cams 16, 17, 18) which have pointed free ends and which are staggered or displaced with respect to one another so that the pointed ends of the cams 16, 17, 18 each show in another direction. These directions, however, include equal angles (in the present embodiment which has three cams, this angle is 120°). These cams 16, 17, 18 cooperate with protrusions 19 of the dispensing means 4, noting that the arrangement of the cams 16, 17, 18 and their orientation is so chosen, that when the handle 11 is slidably moved by hand so that it is slidably moved together with the slider 10 in direction towards the opening 8 of the casing 1, always one single dispensing means 4 only is lifted so that only one single cigarette is moved towards the opening 8. The cigarette 5, during this movement, comes free from the opening 8 with its upper end so that it can be easily grasped by hand and pulled out of the casing 1.

Figure 3:
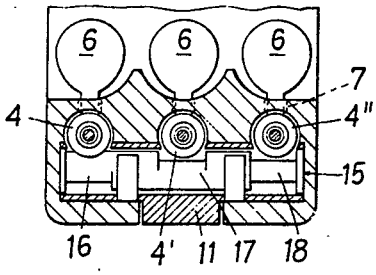
FIG. 3 is a section along the line III—III of FIG. 2.

As the FIGS. 4, 5 and 6 show, the arrangement is such that then, when the lifted dispensing means 4 has reached its upper end position in which its upper end (that is the end which does not show the protrusion 6) engages a stop 20 fixed to the casing ends, the slider 10 can be slidably moved a distance beyond this end position of the dispensing means 4. During this further sliding movement of the slider 10 the cam which engages the protrusion 19 (in the embodiment shown in FIG. 1 this is the cam 16) is pressed downwardly so that the cam shaft 15 is rotated for an angle of 120° so that the cam shaft 15 is rotated from the position shown in FIG. 4 into the position shown in FIG. 5. In this position (FIG. 5) the cam 16 is out of engagement with the protrusion 19 of the first dispensing means 4 mentioned above. When the slider 10 is left free, the spring 14 retracts it by means of the line 13 into the lower end position of the slider 10 and the cam shaft 15 snaps into a position in which the second cam 17 can co-operate with the protrusion 19 of the second dispensing means 4' (FIG. 3). When the cam 17 passes along the protrusion 19, (FIG. 6) it is rotated to such an extent that the pointed end of the cam 17 can move into a position below the protrusion 19, whereafter the cam shaft 15 returns into its position in which the pointed end of the cam 17 comes into engagement with the protrusion 19 when the handle 11 is actuated anew. When doing this, only the second dispensing means 4' is lifted. In the upper end position of this second dispensing means 4', the cam shaft 15 is rotated anew for an angle of 120° so that after lowering of the handle 11 and again lifting it, the cam 18 lifts the third dispensing means 4'' so that the cigarette carried by this dispensing means 4'' is lifted through the opening 8.

Figure 1:
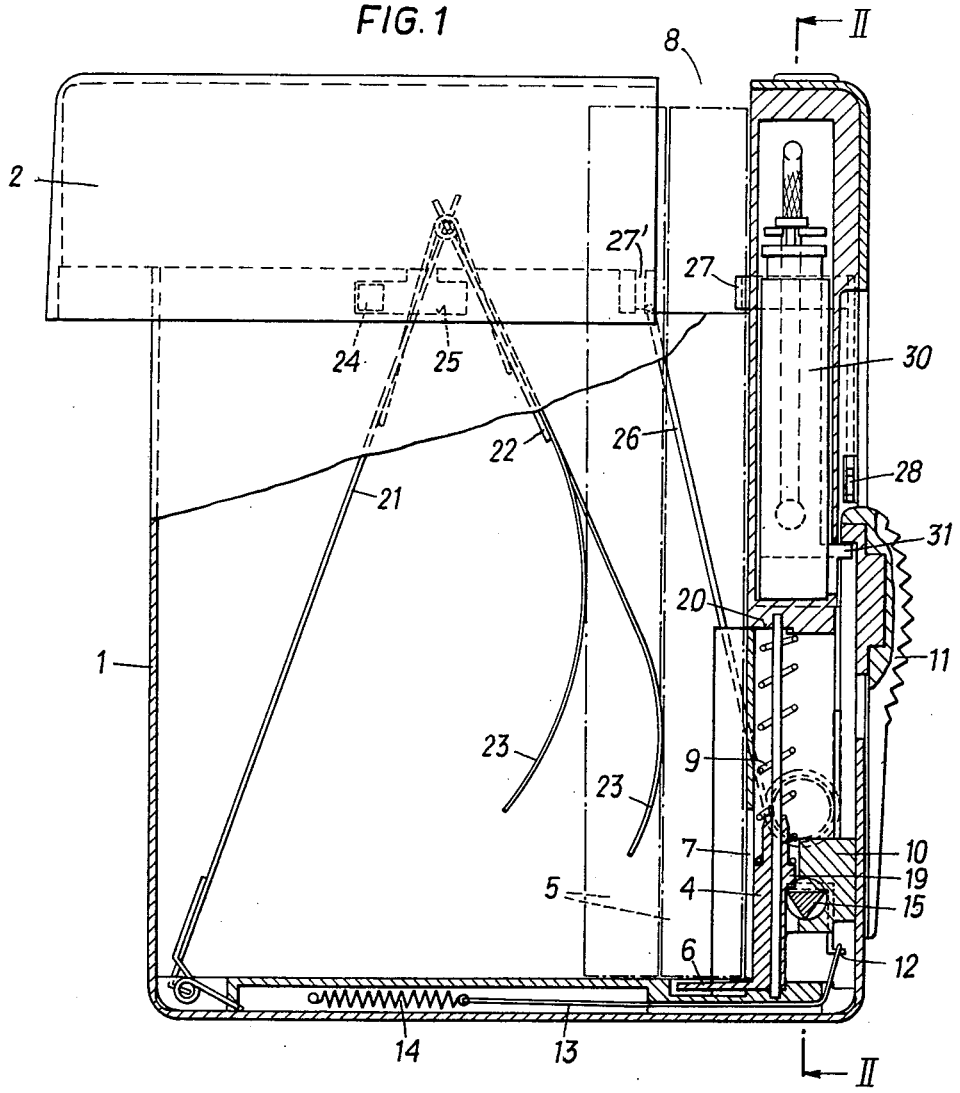
FIG. 1 shows a cigarette dispenser according to the invention in longitudinal section.

As FIG. 1 shows the protrusion 6 of each dispensing means 4, 4', 4'' in its lowermost position enters into a recess of the bottom of the casing 1. In order to secure that, provided that the casing 1 is sufficiently filled with cigarettes, always a cigarette is positioned above the protrusion 6 of each of the dispensing means 4, 4', 4'' a spring preferably a leaf spring is arranged within the casing 1 which spring consists of two resilient spring elements 21, 23 which are connected to each other at their upper ends by a hinge and which are loaded by a spring 22 wound around the axis of this hinge (FIG. 1). The spring element 23 has three tongues for the three rows of cigarettes adapted to be lifted by the three dispensing means 4, 4', 4''. Thus the three rows of cigarettes 5 are urged towards the sidewall of the casing 1 along which the slider 10 and handle 11 are guided.

The cover member 2 is provided with a protrusion 24 on each of its opposite side surfaces which protrusions 24' are guided in longitudinally extending slots 25 of the casing 1, whereby the sliding movement of the cover member 2 is limited. In order to enhance lifting off the cover member 2 for filling the casing 1 with cigarettes, the cover member 2 consists of a material which can be resiliently deformed so that by suitable deforming of the cover member the protrusions 24 can be freed from the slots 25.

A spring 26 preferably a leaf spring urges the cover member 2 into its open position (FIG. 1) in which the opening 8 is free. The cover member has a recess 27' into which a finger 27 snaps when the cover member 2 is shifted into its closing position in which the opening 8 is closed. The finger 27 is connected to a lever 28 having two arms and mounted in the casing 1 for pivotal movement around an axis 29 fixed to the wall of the casing 1. As it can be seen from FIG. 1, the lower end of the lever 28 is positioned in the path of movement of the slider 10 so that the lever 28 is tilted around the axis 29 when the slider 11 is moved upwardly by hand. Thus, when the slider 11 is moved by hand into its upper position in which a cigarette 5 is delivered through the opening 8, the finger 27 is simultaneously released from the recess 27' so that the cover member 2 comes free from the finger 27 and can be shifted into its open position by the spring 26 until the stops formed by the protrusions 24 engage the end of the slots 25. As soon as the cigarette 5 delivered by the dispensing means 4 or 4' or 4'' respectively has been taken off from the casing 1, the cover member 2 is shifted into its closing position by hand in which position the cover member is fixed by the finger 27 snapping into the recess 27). In addition to the releasing means described above for releasing the finger 27, a push button (not shown) may be arranged on the casing 1 which acts on the lever 28 so that the finger 27 is released from the recess 27' when the push button is pressed.

If desired, a lighter 30 may be arranged within the casing above the dispensing means 4, 4', 4'' and above the slider 10. The lighter may have a piezo-crystal—percussion-ignitioner which can be actuated via a protrusion 31 fixed to the actuating mechanism of the ignitioner from the handle 11 so that the ignitioner is actuated for lighting the lighter 30 when the handle 11 is actuated downwardly.

Figure 2:
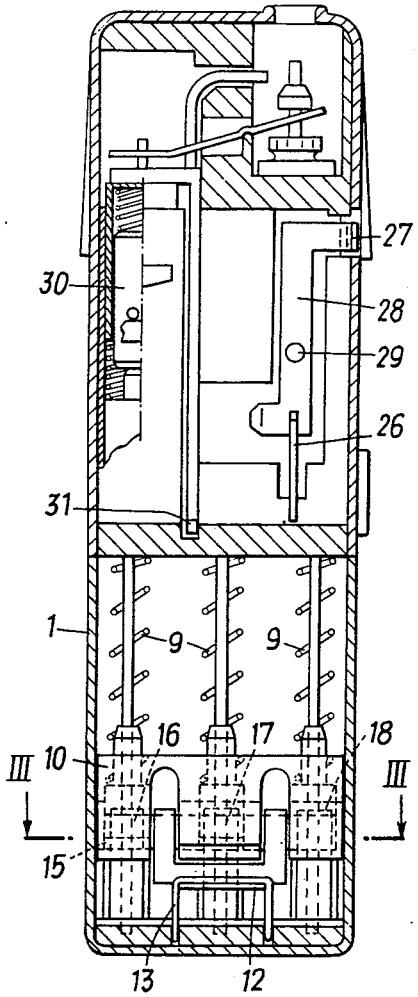
FIG. 2 is a cross section according to the line to the line II—II of FIG. 1.

As it can be best seen from FIGS. 1, 2 and 3, each of the dispensing means 4, 4', 4'' is of shoe-like configuration and is guided for sliding movement against the action of the springs 9 along a rod fixed in the bottom wall and a further wall of the casing 1, this further wall constituting the stops 20.

The cam shaft 15 has circular disks on its both ends (FIGS. 7, 8, 9, 10) with which it is pivotally journalled in the slider 10.

I claim:

1. A dispenser for cigarettes, comprising:

a casing for the cigarettes to be dispensed and having an opening through which the cigarettes may be dispensed, at least two dispensing means slidably guided in said casing towards said opening and away therefrom between a starting position and a dispensing position, each of said dispensing means having a protrusion adapted to underlie a cigarette for moving that cigarette towards said opening of said casing, a transporting mechanism in said casing which urges the cigarettes towards said dispensing means, each of said dispensing means being loaded by resilient means towards the starting position of said dispensing means, a slider means slidably guided in said casing towards said opening and away therefrom by hand between a starting position and a dispensing position, a further resilient means for resiliently urging said slider means towards its starting position, a cam means rotatably mounted in said slider means and having a number of cam surfaces corresponding to the number of dispensing means, said cam surfaces being displaced with respect to each other, seen in circumferential direction of the cam means, a protrusion provided on each of said dispensing means for co-operation with one of said cam surfaces, said slider means being slidably movable beyond said dispensing position towards said opening of said casing, said cam means being rotated when said slider means is moved beyond said dispensing position.

2. A cigarette dispenser as defined in claim 1, wherein said cam means is a cam shaft having cams forming said cam surfaces.

3. A cigarette dispenser as defined in claim 2, wherein each of said cams has a pointed free end.

4. A cigarette dispenser according to claim 1, wherein each of said dispensing means is loaded by a spring means towards its starting position.

5. A cigarette dispenser as claimed in claim 1, wherein said further resilient means is a spring urging said slider means into its starting position, said casing having a bottom wall into which said spring is anchored, and further comprising a line connecting said spring to said slider means.

6. A cigarette dispenser as defined in claim 5, further comprising a bifurcated member embracing said slider means and connected thereto, said bifurcated member being also connected to said line.

7. A cigarette dispenser as defined in claim 1, further comprising a cover member slidably guided on said casing between an open position and a closing position, said opening being closed in said closing position of said cover member, a spring urging said cover member into said open position, a finger for securing said cover member in said closing position, a recess on said cover member, said finger engaging said recess in said closing position of said cover member, a lever for actuating said finger, said lever being actuated by said slider member.

8. A cigarette dispenser according to claim 7, wherein said spring is a leaf spring.

9. A cigarette dispenser according to claim 7, wherein an additional releasing means is provided for releasing said finger from said recess.

10. A cigarette dispenser as defined in claim 1, wherein protrusions are provided on said cover member, said casing having longitudinally extending slots into which said protrusions are inserted for guiding said cover member, said protrusions being releasable from said slots for lifting off said cover member.

11. A cigarette dispenser as claimed in claim 10, wherein said cover member consists of resiliently deformable material.

12. A cigarette dispenser as claimed in claim 1, wherein a lighter is arranged in said casing, said lighter having a piezo-crystal—ignitioning means co-operating with said slider member for ignitioning said lighter.

* * * * *